United States Patent [19]

Behr

[11] Patent Number: 4,667,878

[45] Date of Patent: May 26, 1987

[54] NOZZLE HAVING A CONNECTED COAXIAL ARRANGEMENT FOR A PAINT SPRAYING DEVICE

[75] Inventor: Hans Behr, Stuttgart, Fed. Rep. of Germany

[73] Assignee: Hermann Behr & Sohn GmbH & Co., Fed. Rep. of Germany

[21] Appl. No.: 781,193

[22] Filed: Sep. 25, 1985

Related U.S. Application Data

[63] Continuation of Ser. No. 549,468, Nov. 7, 1983, abandoned.

[30] Foreign Application Priority Data

Nov. 11, 1982 [DE] Fed. Rep. of Germany ... 8231663[U]

[51] Int. Cl.[4] ..... B05B 9/03

[52] U.S. Cl. ..... 239/125; 239/432; 239/569

[58] Field of Search ..... 239/124–126, 239/432, 581–584, 112, 113, 119, 569; 137/563; 251/347

[56] References Cited

U.S. PATENT DOCUMENTS

| | | | |
|---|---|---|---|
| 1,849,050 | 3/1932 | Coatalen | 239/584 X |
| 3,529,626 | 9/1970 | German | 137/563 |
| 3,589,610 | 6/1971 | Wahlin | 239/125 |
| 3,669,354 | 6/1972 | Helyer | 239/126 |
| 3,844,479 | 10/1974 | Needham | 239/125 |
| 3,949,970 | 4/1976 | ter Braak | 239/432 X |
| 3,985,300 | 10/1976 | Pinney | 239/125 X |

*Primary Examiner*—Duane A. Reger
*Assistant Examiner*—Daniel R. Edelbrock
*Attorney, Agent, or Firm*—Reising, Ethington, Barnard, Perry & Milton

[57] ABSTRACT

The invention relates to a nozzle for a paint spraying device having a radially inward valve needle that is connected in a coaxial arrangement with the nozzle. A radially outward paint supply pipe is connected to the valve at one end and a paint source at the other. The valve needle is hollow for paint supply purposes and has a forwardly inclined bore in its tip which opens axially in front of the valve into an annular chamber created between the valve needle and the supply pipe.

5 Claims, 1 Drawing Figure

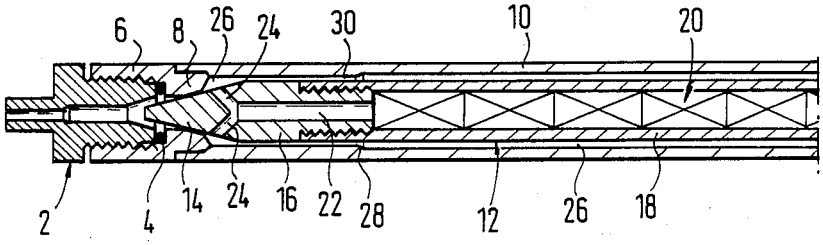
6
8
26
24
30
10
20
2
4
14
24
16
22
28
12
26
18

NOZZLE HAVING A CONNECTED COAXIAL ARRANGEMENT FOR A PAINT SPRAYING DEVICE

RELATED APPLICATION

This application is a continuation of U.S. Ser. No. 549,468, filed Nov. 7, 1983, now abandoned.

BACKGROUND OF THE INVENTION

The present invention relates to a coaxial arrangement of a radially inward valve needle, the conical tip of which forms the valve body of a seat valve of a paint spraying device, and at least one radially outward paint supply pipe, the end, opposite the valve, can be connected to a paint source or paint pot. As a result, when the paint supply pipe valve is closed, standing paint can circulate or at least be forced to return in order to rinse the closed, far-forward extending circulatory path through the paint supply and return pipes. This prevents harmful emissions from escaping from the paint spraying device, which thus only needs to be cleaned in the portion thereof lying downstream of the paint valve itself. Only small quantities of rinsing fluid enter the air of the spray chamber which renders avoidable the periodic use of a difficult-to-clean apparatus for capturing the mixture of residual paint and rinse solution, thus saving expense. In the known device, however, it is unavoidable that paint will be deposited on the inner surfaces of the paint supply and paint return pipes, so that a change in paint color requires a surface cleaning in which a certain loss of paint is intrinsic.

It is indeed known from German DE-PS No. 27 57 522 (Bahr) to use a hollow valve needle. In this reference, however, control or atomizing air is introduced, while the paint to be atomized is supplied on the radially outside surface of the valve needle toward the end of said valve needle, which widens toward the front.

SUMMARY AND OBJECTS OF THE INVENTION

The object of the invention, therefore, is to create a coaxial arrangement for the paint supply and return of a paint spraying device which requires a small cleaning expense and results in small paint losses.

This object is achieved with a coaxial arrangement of the above-described type in accordance with the invention, in that the valve needle is hollow for paint supply purposes and is provided with at least one forwardly inclined bore in the needle tip which opens axially in front of the valve in the annular chamber between the needle and the supply pipe. The paint return pipe surrounds the hollow needle for paint return, whereby the paint flow resistance downstream axially in front of the bore opening when the paint valve is open is made less than the resistance axially behind this opening by blocking the paint return. In this manner it is advantageously achieved that, as compared with the known coaxial arrangement, with the same inside cross-sectional area of the paint supply, a smaller inner surface area for the paint supply is present, which naturally incorporates smaller losses from deposited paint that is rinsed out for purposes of cleaning the paint supply. As a result, when the paint is changed, the paint supply can also be rinsed more quickly, so that the change-over time is shortened.

With the foregoing and other objects, advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWING

FIG. 1 is a cross-sectional view of the device of the present invention.

DETAILED DESCRIPTION OF A PREFERRED EMBODIMENT

In a preferred embodiment of the coaxial arrangement according to the invention the valve needle includes a pipe, at the axially forward end of which is connected a stepped element which forms the needle tip and is provided with an angled bore, and an axial blind bore which opens on one end into the pipe of the valve needle and on the other end into the angled bore. For purposes of the invention, a plurality of angled bores are provided, which are distributed uniformly about the periphery of the needle tip. When the valve is open, these angled bores offer a relatively small flow resistance and also change the course of the thus-divided paint flow into the paint return. The valve needle in this proposed embodiment can be relatively simply and inexpensively manufactured.

Many components of a paint fluid, for example, the base lacquer and hardener of a two-component lacquer, are to be separately introduced into close proximity of the atomization location and subsequently mixed as they are conveyed over the remaining distance to the atomization location. Accordingly, in the preferred exemplary embodiment it is provided that the valve needle contains a static mixer.

The "tip" of the valve needle can be any shape of the end of the needle used as the valve body, since its diameter is always small in comparison to the needle length. Instead of a conical valve a plate valve could also be formed by means of a needle "tip" abutting bluntly against a smooth-surfaced valve seat.

The invention is described below with the aid of the exemplary embodiment of the coaxial arrangement according to the invention as shown in the drawing. The single figure in the drawing shows a right break-away central longitudinal section through the exemplary embodiment.

A paint nozzle 2 of a paint spraying device (otherwise not shown) is screwed into the axial, cylindrical projection 6 of a conical valve seat 8 with an O-ring 4 therebetween, which valve seat 8 fits into the front end of a radially outward paint supply pipe 10 which serves to return the paint. The pipe 10 surrounds a coaxial, hollow valve needle 12, the conical tip 14 of which forms a valve body which cooperates with the valve seat 8 and is part of a stepped element 16. This stepped element 16 is glued into the front end of a radially inward paint supply pipe 18 forming the primary portion of the valve needle 12. The hollow chamber of this paint supply pipe 18 contains a static mixer 20, which, as indicated, operates without movable parts, in that the fluids to be mixed, such as base lacquer and hardener, are forced through a labyrinth or between chicanes, becoming thoroughly mixed. Such mixers are available commercially. The stepped element 16 includes an axial blind bore 22, which opens at the front end of the mixer 20 into the hollow chamber of the pipe 18. A plurality of angled, forwardly diverging bores 24, which are uniformly distributed about the periphery of the needle tip 14 emanate from the inner end of this blind bore 22. The diverging bores 24, as seen in the flow direction, open into an annular chamber 26 between the valve needle 12 and the paint return pipe 10 at a point axially in front of the valve 8–14. By means of a radial, narrow, longitudinal collar 28 of the pipe 10, said pipe guides the stepped element 16 while forming a slight space 30, which assures that the flow resistance for the returned paint is greater than the flow resistance in the open valve for the paint supplied to the paint spraying device.

This device can have a rotating atomizing bell or disc, onto the surface of which the paint passes as it leaves the nozzle 2.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A paint spray coating assembly for supplying paint coating material to an atomizer for atomizing the coating material and depositing the atomized material upon the surface of an object, said assembly comprising; a nozzle (2) for connection to an atomizer, feed line means (12) for supplying the material flow axially from a supply system to said nozzle (2), and including return line means (10) for allowing the material to return to the supply system, mixing means (20) disposed within said feed line means (12) for homogeneously mixing at least two coating materials before the material flow enters said nozzle (2), said feed line means (12) including a tubular feed line (18) coaxially disposed within said return line means (10), a needle (16) disposed adjacent one end of said mixing means (20) and threadably secured to one end of said feed line (18), said needle having a central passageway (22) allowing the mixed material to enter from said feed line (18) and having at least one discharge bore (24) diverging outwardly and axially in the direction of material flow from said central passageway (22) to allow the mixed material to exit from said feed line (18) and said needle (16), said return line means (10) including a tubular return line (10) having a radial longitudinal collar (28) creating a flow resistance of the material returning to the supply system greater than the flow resistance of the material entering said nozzle (2).

2. An assembly as set forth in claim 1 further including a valve seat (8) for coacting with said needle (16), said needle (16) having a first position for allowing the material to enter said nozzle (2), and a second position preventing the material from entering said nozzle (2) and returning the material to the supply system through said return line means (10).

3. An assembly as set forth in claim 2 including a valve body (6) connected to said return line (10) and defining said valve seat (8), said needle (16) having a tip (14), said seat (8) and said tip (14) being conically shaped for said seat (8) complimentarily receiving said tip (14) to meter material flow.

4. An assembly as set forth in claim 3 further including an annular chamber (26) defined by said tip (14) of said needle (16) and said return line (10) and said valve body (6), said bore (24) of said needle (16) supplying the material from said central passage (22) of said needle (16) to said chamber (26).

5. An assembly as set forth in claim 4 wherein said mixing means (20) includes a static mixer (20).

* * * * *